US007311020B2

(12) United States Patent
George

(10) Patent No.: US 7,311,020 B2
(45) Date of Patent: Dec. 25, 2007

(54) TOOL FOR OPERATING SUBTERRANEAN UTILITY VALVES

(76) Inventor: Stephen D. George, 3142 State Route 956, New Castle, PA (US) 16105

( * ) Notice: Subject to any disclaimer, the term of this patent is extended or adjusted under 35 U.S.C. 154(b) by 0 days.

(21) Appl. No.: 11/336,800

(22) Filed: Jan. 20, 2006

(65) Prior Publication Data

US 2006/0162504 A1 Jul. 27, 2006

Related U.S. Application Data

(60) Provisional application No. 60/647,211, filed on Jan. 26, 2005.

(51) Int. Cl.
*B25B 13/28* (2006.01)
*B25B 13/18* (2006.01)
*B25B 23/10* (2006.01)

(52) U.S. Cl. ..... 81/90.2; 81/55; 81/128; 81/451

(58) Field of Classification Search ..... 81/90.2, 81/90.3, 90.1, 126, 128, 177.5, 55, 113, 451; 137/368–370; 251/288, 293
See application file for complete search history.

(56) References Cited

U.S. PATENT DOCUMENTS 58,306 A * 9/1866 Sedgwick ..... 81/128
531,715 A * 1/1895 Brown ..... 81/128
1,395,585 A * 11/1921 Kizer ..... 81/128
1,441,183 A * 1/1923 Silver ..... 81/128
2,669,896 A * 2/1954 Clough ..... 81/128
3,377,893 A * 4/1968 Shorb ..... 81/113
3,891,181 A * 6/1975 Sanders ..... 137/368
4,573,378 A 3/1986 McDonald
6,539,826 B2 * 4/2003 Oesterle et al. ..... 81/90.2

* cited by examiner

*Primary Examiner*—Hadi Shakeri
(74) *Attorney, Agent, or Firm*—James Ray & Assoc.

(57) ABSTRACT

A tool for operating a subterranean utility valve having limited accessibility includes a hollow housing with a plurality of elongated members mounted for sliding movement within the housing. Each elongated member is movable in a direction away from the first open end of the housing for placement about a valve nut of such utility valve. A handle is connected to the housing for biasing elongated members for engagement with such valve nut and for generating a torque enabling rotation of such valve nut in order to control flow through such utility valve. A rigid member is connected to plurality of elongated members for retaining and remotely moving them within the hollow housing.

6 Claims, 2 Drawing Sheets

TOOL FOR OPERATING SUBTERRANEAN UTILITY VALVES

CROSS-REFERENCE TO RELATED APPLICATIONS

This application is related to and claims priory from Provisional Patent Application Ser. No. 60/647,211 filed Jan. 26, 2005.

FIELD OF THE INVENTION

The present invention relates, in general, to manual tools and, more particularly, this invention relates to manual tools for operating limited accessibility subterranean utility valves.

BACKGROUND OF THE INVENTION

As is generally well known, the square and hex shape of an outer surface of fasteners, such as nuts, screws and bolts, deforms during an extended use thus precluding use of well known female drive devices such as sockets, open end wrenches, ratchets and the like, due to excessive slippage, and requiring use of pliers to turn such fastener. The problem arises when such deformed fastener is located in an area with a limited access which prevents use of pliers or when the torque applied through the use of pliers is not sufficient to rotate the deformed fastener.

The presently available sockets and wrenches do not alleviate the problems associated with deformed fasteners.

As is further generally well known, municipal water systems utilize a network of subterranean shut-off utility valves which are generally located 3 to 4 feet below ground level and which are accessible from the ground level through a vertically disposed cylindrical conduit. Such cylindrical conduit is of a diameter adequate only to receive a valve wrench for engagement with a square nut of the valve stem which must be rotated in order to open and close such valve.

During extended use of rotating the nut in order to control water flow, the edges of the nut deteriorate resulting in somewhat of a rounded shape of the nut. Such rounded shape does not enable engagement with the square drive portion of the presently used valve wrenches sufficient to rotate the deformed nut and therefore does not allow the wrench to open and close the valve. When a valve with a rounded nut is encountered, the water flow is usually controlled at adjacent valve locations permitting use of the valve wrench. However, such situation increases costs due to time and effort required to locate such adjacently disposed valve and requires added time to reach such adjacently disposed valve.

Such time is generally not available in an emergency situation and results in excavation efforts sufficient to use tools and other means which are capable of turning a rounded nut. The need for excavation and subsequent restoration of the excavated area further increases project costs and may disrupt human and auto traffic.

SUMMARY OF THE INVENTION

According to one embodiment, the present invention provides a tool for operating a subterranean utility valve having limited accessibility. Such tool includes a hollow housing having an open end. A plurality of elongated members are mounted for sliding movement within the housing. Each elongated member is movable in a direction away from the first open end of the housing for placement about a valve nut of such utility valve. A handle is connected to the housing for biasing elongated members for substantial engagement with such valve nut and for generating torque enabling rotation of such valve nut in order to control flow through such utility valve. A rigid member is connected to each of such plurality of elongated members for retaining and remotely moving them within the hollow housing.

According to another embodiment, the present invention provides a female drive device for at least one of a hand and a power tool. The device includes a hollow housing having each of a predetermined shape and a predetermined size and having a first open end. A coupling means is engageable with an opposed generally closed second end of the housing for coupling the housing to such at least one of the hand and power tool and for enabling rotation of the housing. At least a pair of elongated members are slideably mounted within the housing. Such at least a pair of means substantially abut and transfer a torque, applied to the housing by a rotation of such at least one of such hand and power tool to a predetermined portion of a fastener.

OBJECTS OF THE INVENTION

It is, therefore, one of the primary objects of the present invention to provide a tool for turning a fastener having a generally rounded shape.

Another object of the present invention is to provide a tool for turning a fastener having a generally rounded shape which accommodates a plurality of fastener sizes.

Yet another object of the present invention is to provide a tool for turning a fastener having a generally rounded shape which is economical to manufacture.

A further object of the present invention is to provide a tool for turning a fastener having a generally rounded shape and which is mounted on a subterranean utility valve.

In addition to the several objects and advantages of the present invention which have been described with some degree of specificity above, various other objects and advantages of the invention will become more readily apparent to those persons who are skilled in the relevant art from the following more detailed description, particularly, when such description is taken in conjunction with the attached drawing Figures and with the appended claims.

BRIEF DESCRIPTION OF THE VARIOUS EMBODIMENTS OF THE INVENTION

Figure 1:
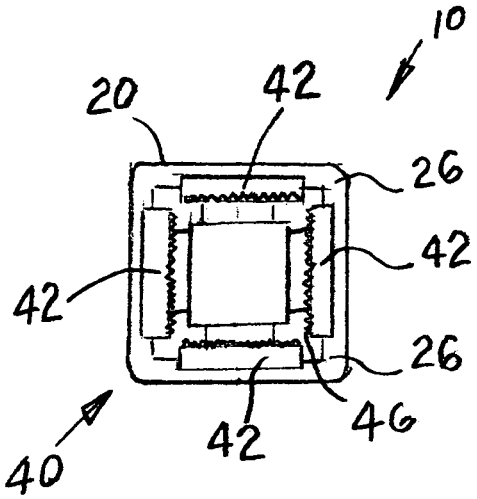
FIG. 1 is an end view of the device according to one embodiment of the invention.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
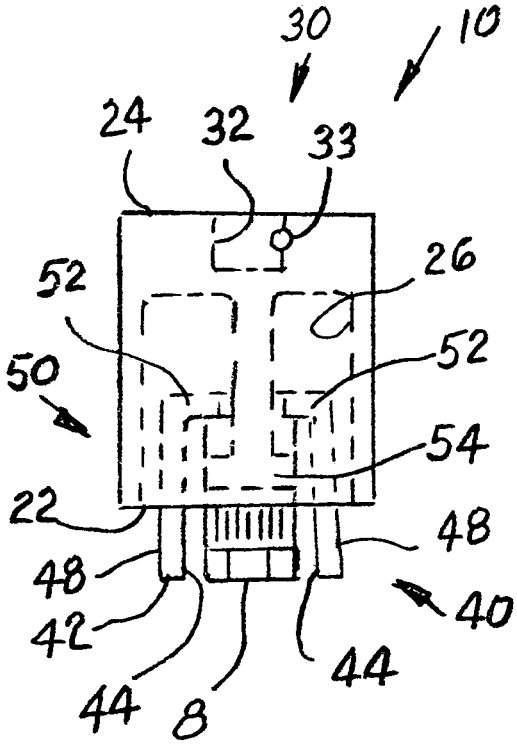
FIG. 2 is a side elevation view of the device of FIG. 1.
Figure 3:
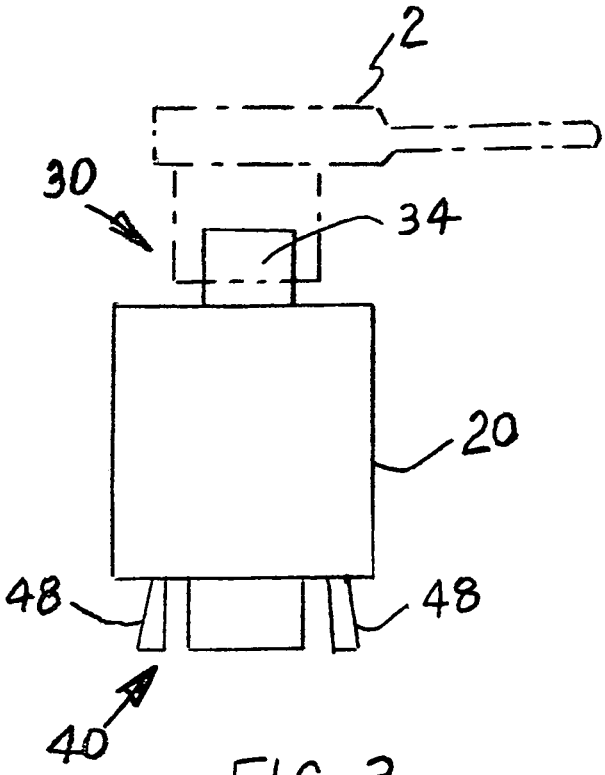
FIG. 3 is a side elevation view of the device of FIG. 1, particularly showing an alternative means for coupling such device to a hand tool.

Reference is now made, to FIGS. 1-3, wherein there is shown a female drive device, generally designated 10, according to a first embodiment of the invention, for at least one of a hand or power tool 2. The female drive device 10 includes a hollow housing 20 having each of a predetermined shape and a predetermined size and having a first open end 22.

There is means, generally designated 30, which is engageable with an opposed generally closed second end 24 of the housing 20 for coupling the housing 20 to such at least one of such hand or power tool 2 and for enabling rotation of the housing 20.

At least a pair of means, generally designated 40, are slideably mounted within the housing 20. Each of such at least a pair of means 40 substantially abuts and transfers a torque to a predetermined portion of a fastener 8, wherein the torque is applied to the housing 20 by rotation of such at least one of such hand or power tool 2.

In the presently preferred embodiment of the invention, the housing 20 has a generally square cross section and such at least a pair of means 40 is a quartet of elongated members 42. Each elongated member 42 is mounted for sliding movement within the housing 20 and is movable in a first direction away from the first open end 22 of the housing 20 for placement about the predetermined portion of such fastener 8 and is movable in an opposed second direction for enabling the housing 20 to bias the elongated member 42 for substantial engagement with the predetermined portion of such fastener 8 and to transfer the torque thereto.

Each elongated member 42 has a first surface 44 oriented toward the predetermined portion of such fastener 8 and which has at least a portion thereof adapted with an anti-slip means 46 such as a predetermined plurality of ridges 46 having a predetermined height and disposed in a predetermined pattern. Such first surface 44 is one of flat and convex.

A second surface 48 of each elongated member 42 is oriented toward the housing 20 and is tapered from a point disposed adjacent a first end of the elongated member 42 outwardly and at an acute angle relative to longitudinal axis of the device 10. Such tapered second surface 48 enables the housing 20 to bias the first surface 44 of the elongated member 42 for abutment with the predetermined portion of such fastener 8. Alternatively, the inner surfaces 26 of the hollow housing 20 may be tapered to bias the first surface 44 of the elongated member 42 for abutment with the predetermined portion of such fastener 8.

A material of each of the housing 20 and each elongated member 42 may be one of metal and thermoplastic. Furthermore, a tensile strength of at least the anti-slip means 46 of each elongated member 42 formed from a metallic material may be increased by a hardening method to reduce deterioration of such anti-slip means 46 and extend the life of elongated member 42. Alternatively, a predetermined coating (not shown) which increases tensile strength of the substrate material such coating is being applied to may be applied to the anti-slip means 46.

In further reference to FIG. 2, the device 10 includes a stop means, generally designated 50, which preferably is a plurality of flanges 52 each extending perpendicular to the first surface 44 of the respective elongated member 42 and which cooperates with a rigid member 54 connected to the second end 24 of the housing 20 for controlling the extension of each elongated member 42 through the open end 22 of the hollow housing 20.

The coupling means 30 may be one of a cavity 32 disposed in the second end 24 and extending toward the first open end 22 of the housing 20, as best shown in FIG. 2, and a shaft portion 34 coaxially extending outwardly from the generally closed second end 24, as best shown in FIG. 3. Preferably, the cavity 32 has a square cross section for coupling to a male square end of the tool 2 or, alternatively, a hexagon cross section when such tool 2 is a well known hexagon shaped Allen key. Such cavity 32 may be further adapted with a well known ball detent 33. Accordingly, the shaft portion 34 may have a square cross section for coupling to a female end of the tool 2 or a hexagon cross section for mating with the tool 2 being an open end box wrench and the like.

The device 10 may further include means for guiding movement of each elongated member 42 which is preferably a plurality of ridges 26 integrally disposed within the housing 20 and engaging edges of each elongated member 42.

In operation, each elongated member 42 is moved in a first direction outwardly from the open end 22 of the housing 20 and positioned about the outer surface of the fastener 8. The housing 20 is then moved toward the fastener 8 engaging the second outer surface 48 of each elongated member 42 and biasing a first surface 44 thereof for abutment with the outer surface of the fastener 8. The housing 20 is then rotated by way of the tool 2 and applies torque, generated by the tool 2, to each elongated member 42 and subsequently to the fastener 8. The use of anti-slip means 46 enables positive engagement of the elongated member 42 with the fastener 8 and, more particularly, enables rotation of such fastener 8 having a deformed outer shape.

Figure 4:
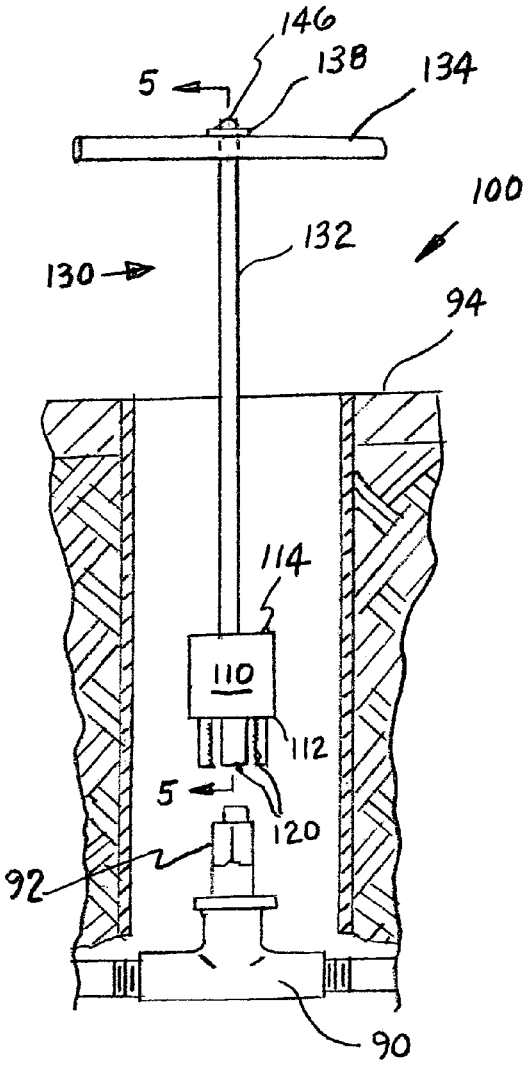
FIG. 4 is a side elevation view of the tool according to another embodiment of the invention for operating subterranean utility valves.
Figure 5:
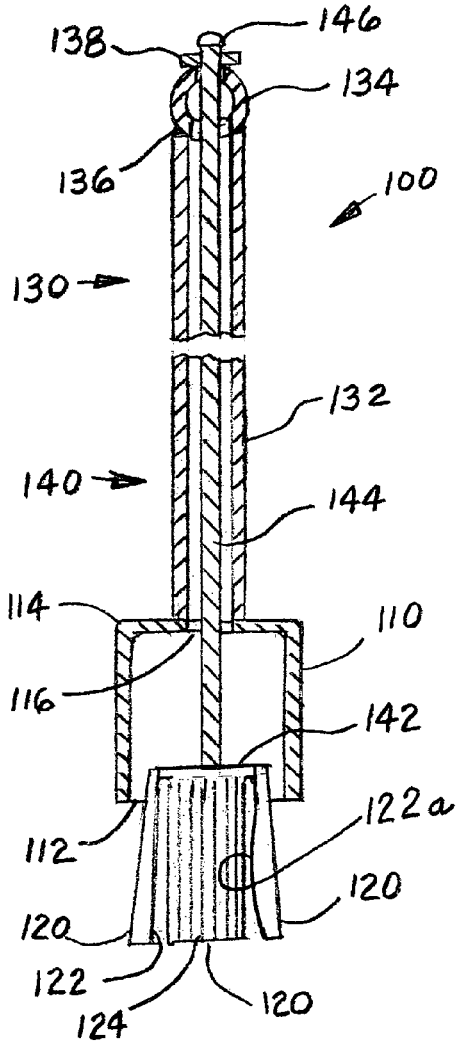
FIG. 5 is a cross sectional view of the tool for operating subterranean utility valves along lines 5-5 of FIG. 4.

According to a second embodiment, best shown in FIGS. 4-5, the present invention provides a manually operated tool, generally designated 100, for use with a subterranean utility valve 90 having limited accessibility. The utility valve 90 is generally disposed at the end of the vertical conduit 94 and at a distance of three to four feet below the ground level 96.

Such tool 100 includes a hollow housing 110 having each of a predetermined shape and a predetermined size and having a first open end 112. The hollow housing 110 is adapted to slideably receive at least a pair of elongated members 120.

In the presently preferred embodiment of the invention, the housing 110 has a generally square cross section and such at least a pair of elongated members 120 is a quartet of elongated members 120. Each of the elongated member 120 is movable in a first direction away from the first open end 112 of the housing 110 for placement about a valve nut 92 of such utility valve 90 and movable in an opposed second direction for enabling the housing 110 to bias the elongated member 120 for substantial engagement with such valve nut 92 and transfer the torque thereto.

Each elongated member 120 has a first surface 122 oriented toward the predetermined portion of the valve nut 92 and has at least a portion thereof equipped with an anti-slip means 124 such as a predetermined plurality of ridges 124 having a predetermined height and disposed in a predetermined pattern. as shown by reference numeral **122*a* in FIG. 5**.

There is a handle means, generally designated 130, connected to the housing 110 in one of a removable and rigid configuration. It is presently preferred that such handle means 130 includes a hollow member 132 which is rigidly attached to a generally closed second end 114 of the housing 110 and which is disposed coaxially with a longitudinal axis of such tool 100. The second end 114 of the housing 110 has an aperture 116 which is in open communication with the hollow member 132. A handle member 134 is rigidly and perpendicularly attached to the hollow member 132 at a free end thereof and has an aperture 136 in communication with the hollow member 132.

The tool 100 further includes a means, generally designated 140, for retaining and remotely operating each elongated member 120. In the presently preferred embodiment of the invention, such retaining and operating means 140 includes a rigid member 142 connecting respective ends of each of the elongated members 120 that are oriented towards the opposed second end 124 of the housing 110 and a shaft like member 144 attached to the rigid member 142 and slideably disposed within the hollow member 132 of the handle means 130. The end of the shaft like member 144 which extends through the aperture 136 of the handle member 134 is adapted with a stop 146 which abuts the handle member 134 when the elongated members 120 are extended outwardly from the open end 112 of the hollow housing 110 thus preventing disengagement of the elongated members 120 from the housing 110. The stop 146 may be further used as a base for receiving a striking force applied to the tool 110 in order to enable additional abutment of each elongated member 120 with the valve nut 92. The aperture 136 may be provided with a reinforcement collar 138.

In operation, the tool 100 is first inserted into the conduit 94 and means 140 is slideably operated to place the elongated members 120 about the valve nut 92. The handle member 134 is then pushed downwardly to engage the housing 110 with the second surface 126 of each of the elongated members 120 in order to achieve the requisite amount of engagement thereof with the valve nut 92. The handle member 134 is then rotated in order to apply sufficient torque to each elongated member 120 and subsequently to the valve nut 92. It will be appreciated that the length of the shaft like member 144 will be selected so as to enable the handle member 134 to be disposed above ground level 96 and further enabling ease of rotation of such handle member 134.

Thus, the present invention has been described in such full, clear, concise and exact terms as to enable any person skilled in the art to which it pertains to make and use the same. It will be understood that additional variations, modifications, equivalents and substitutions for various components of the specifically described embodiments of the invention may be made by those persons skilled in the art without departing from the spirit of the invention and the scope of such invention as set forth in the appended claims.

I claim:

1. In combination with a subterranean utility valve having limited accessibility a tool for controlling flow through the utility valve, said tool comprising:

(a) a generally hollow housing having each of a predetermined shape and a predetermined size and having an open first end;

(b) at least a pair of elongated members mounted for sliding movement within said housing, each of said at least a pair of elongated members movable in a first direction away from said open first end of said housing for placement about a valve nut of such utility valve;

(c) a handle assembly connected to said housing for positioning said at least a pair of elongated members for engagement with such valve nut and for applying sufficient torque to enable rotation of such valve nut and for controlling flow through such utility valve;

(d) retaining and operating means engageable with said at least a pair of elongated members for retaining them within said hollow housing and for remotely moving them in said first direction and in an opposed second direction;

wherein said handle assembly includes a hollow member rigidly attached to a generally closed second end of said housing and disposed coaxially with a longitudinal axis of said tool, said second end of said housing has a first aperture in open communication with one end of said hollow member and a handle member rigidly and perpendicularly attached to said hollow member at a free end thereof and having a second aperture in communication with said free end of said hollow member;

wherein said retaining and operating means includes a rigid member connecting respective ends of each of said at least a pair of elongated members oriented toward said second end of said housing and a shaft member attached to said rigid member and slideably disposed within said hollow member of said handle assembly; and wherein said handle assembly includes a stop member connected to an end of said shaft member extending through said hollow member and said handle member, the stop member being located at a distal end along a central longitudinal axis of said shaft member whereby said stop member abuts an exterior surface portion of said handle member for preventing disengagement of said at least pair of elongated members from said hollow housing.

2. The tool, according to claim 1, wherein at least a portion of a first surface of each of said at least a pair of elongated members oriented toward said valve nut includes an anti-slip means.

3. The tool, according to claim 2, wherein said anti-slip means is a predetermined plurality of ridges having a predetermined height and disposed in a predetermined pattern.

4. The tool, according to claim 1, wherein a first surface of each of said at least a pair of elongated members oriented toward said valve nut is one of flat and convex.

5. The tool, according to claim 1, wherein a second surface of each of said at least a pair of elongated members oriented toward said housing is tapered from a point disposed adjacent a first end of said elongated member outwardly and at an acute angle relative to a longitudinal axis of said tool, said tapered second surface for enabling said housing to bias said each of said at least a pair of elongated members for abutment with said predetermined portion of such fastener.

6. The tool, according to claim 1, wherein a material of each of said housing and each of said at least a pair of elongated members is one of metal and thermoplastic.

* * * * *